US005108035A

United States Patent [19]

Friedrichs

[11] Patent Number: 5,108,035

[45] Date of Patent: Apr. 28, 1992

[54] FLUID JETTING DEVICE FOR CLEANING SURFACES

[76] Inventor: Ingo R. Friedrichs, Grünstiege 9, 4432 Gronau, Fed. Rep. of Germany

[21] Appl. No.: 512,666

[22] Filed: Apr. 20, 1990

[30] Foreign Application Priority Data

Apr. 20, 1989 [AT] Austria ..... 947/89

[51] Int. Cl.[5] ..... B05B 3/04

[52] U.S. Cl. ..... 239/227; 239/240; 239/381

[58] Field of Search ..... 239/237, 240, 227, 229, 239/380, 381, DIG. 19; 74/48, 50

[56] References Cited

U.S. PATENT DOCUMENTS

| | | | |
|---|---|---|---|
| 3,058,667 | 10/1962 | Weiss | 239/227 |
| 3,094,254 | 6/1963 | Cullen et al. | 239/227 |
| 3,458,136 | 7/1969 | Belaieff | 239/227 |
| 3,874,595 | 4/1975 | Rindisbacher | 239/227 |
| 4,592,506 | 6/1986 | Capes et al. | 239/DIG. 19 |
| 4,732,325 | 3/1988 | Jensen et al. | 239/DIG. 19 |
| 4,802,628 | 2/1989 | Dautel et al. | 239/240 |

FOREIGN PATENT DOCUMENTS

| | | | |
|---|---|---|---|
| 1139250 | 11/1962 | Fed. Rep. of Germany | 239/251 |

*Primary Examiner*—Andres Kashnikow
*Assistant Examiner*—Christopher G. Trainor
*Attorney, Agent, or Firm*—Michael J. Striker

[57] ABSTRACT

The fluid jetting device for cleaning surfaces comprises a housing having a fluid inlet for pressurized fluid and a first pressurized fluid space connected with at least one movable high pressure nozzle residing in the housing. A high pressure seal is formed between the nozzle and the housing. At least one mechanical separating means is provided in the housing to form a second pressurized fluid space containing another pressurized fluid, advantageously oil, adjacent the high pressure seal. The second pressurized fluid space is separated from the first pressurized fluid space by mechanical separating means to prevent dirt from reaching the second pressurized fluid space and the high pressure seal but the mechanical separating means allows transmission of fluid pressure in the first fluid space to the other fluid to allow pressure balancing. The sliding surfaces on adjoining sliding members at the high pressure seal may be made of ceramic material to increase life and reduce friction and wear. The coupling between the nozzle-driving motor means and the nozzle may be indirect and structured so that the nozzle is driven at constant speed to assist in reducing friction and wear.

18 Claims, 5 Drawing Sheets

FLUID JETTING DEVICE FOR CLEANING SURFACES

BACKGROUND OF THE INVENTION

The present invention relates to a method and device for improving the effects of at least one movable high pressure nozzle producing a high pressure jet of pressurized fluid, particularly in a high pressure washer. The jetting direction of the high pressure jet is continuously changed by action of the pressurized fluid.

According to German Patent 3 419 964 a device is known having a rotating pencil jet nozzle directly connected to a turbine wheel. In this device it is disadvantageous that the entire outer sliding diameter D of the rotating nozzle member must move over the complete circumference, resulting in high friction, heat generation and increased wear, which, in turn, causes reduced load capacity and shortens the life of the device. According to German Patent DE-GM 88 07 562.1 it is known to reduce these negative effects by a slim seal edge working against a sealing surface. However the principal disadvantages remain, since at constant nozzle rotation speed the same and possibly an increased rotational displacement must occur with possibly correspondingly increased friction. German Patent 34 19 964 describes a device having similar problems. According to German Patent 36 23 368 a nonrotating nozzle is moved within a ball joint, so that the jet describes a conical shape, producing a smaller effective friction diameter d and a reduced displacement during rotation, $\pi$ d. However despite some improvement, the desired lengthening of the life of the device does not take place. According to German Patent DE-Gbm GM 80 29 704 a nozzle is swiveled back and forth within a certain angle. The reduced angular displacement is advantageous. However the increased diameter D for jet rotation again results in the same disadvantages. According to German Patent DE-GM 8 029 704 and German Published Patent Application DE-OS 37 24 65, the nozzle can be supported by a ball joint. In this device it is still disadvantageous that no relatively constant sliding speed over a working rotation angle can be achieved (in particular the sliding speed is considerable, when the turbine cam is moving closest to the nozzle joint), so that the technically achievable load limits (namely the p·v-Factor as friction heat factor, i.e. the product of pressure p and sliding speed, v), cannot be fully utilized, since pressure p must be reduced, when speed v is increased to limit the friction so that the heat generation is acceptable.

In all these devices, it is disadvantageous that the technically possible load limits at a given nozzle frequency either determined by selection of a sliding diameter (thereby the sliding displacement is multiplied by $\pi$) and/or by selection of a speed increase over a certain angular segment cannot be realized. In all these devices dirt carried along by the passing fluid will reach the sliding parts, thereby causing additional friction and wear. A full microfiltration of the complete fluid does not provide a feasible solution to the problem, since it is too expensive and difficult.

Finally the design of movable nozzles for situations requiring a long life with loads in excess of about 180 bar/2,500 psi has been impossible, since the three basic load problems at the sealing joint of these nozzles (sliding speed under pressure causing heat generation; constant sliding speed; and prevention of access of dirt) have up to now remained unsolved. In particular, the p·v-Factors formed an insurmountable barrier.

SUMMARY OF THE INVENTION

It is an object of the present invention to provide an improved movable high pressure jetting device of the above-described type capable of handling increased work pressure and having a greater endurance than those currently available.

It is also an object of the present invention to provide an improved movable high pressure jetting device which has reduced load at a high pressure sealing joint for the pressurized fluid during its operating life, especially when the sealing members of the sealing joint are sliding and the sliding surfaces at the joint are mechanically touching each other.

These objects and others are attained by the foregoing:

1. The working pressure of the jetting fluid is transmitted to a second clean fluid and from there to the nozzle joint where the movable jet is produced, so that the nozzle joint is contacted only by clean fluid. As a result, dirt particles, minerals within the jetting fluid, scale or added chemicals cannot reach the nozzle joint, cannot sediment or rest at the sliding surfaces thereof. They thereby neither produce higher friction nor damage the surfaces nor generate heat, so that not only higher p·v-Factors are achieved, but also the device has a lengthened life as well. It should be carefully noted that substantial amounts of contamination and minerals are carried along even by "clean" tap water. This contamination is commonly known as sediments, scale or solid mineral particles.

2. The nozzle creating the pressure jet is driven by an additional mechanical element, which, in turn, is driven by a fluid motor (e.g. axial or radial turbine). Consequently, the nozzle movement can be selected without restriction as required. However, particularly it can be designed to achieve a relatively constant sliding movement over a comparatively large time interval or a sinusoidal displacement when movin back and forth, so that the sliding surfaces experience a comparatively constant speed and thereby allow a higher load to be tolerated, when compared to current devices.

3. At least one sliding nozzle joint part—preferably the less thermally stressed part—producing the moving jet has a super-hard surface of heat resistant ceramic material, e.g. aluminum oxide. Consequently a higher p·v-Factor can be achieved. This higher p·v-Factor is results from by a comparatively higher wear resistance and higher thermal stress resistance, since the heat generated can be transferred relatively easily through the thin coating and from there to the base material.

The entire movable nozzle and/or its supporting cup can be made of the super-hard and heat resistance material. As a result, manufacturing process economies can result, particularly in the case of small nozzles.

4. The working pressure of the jetting fluid is applied to the region between the sliding members of the nozzle joint so that at least a portion of the sliding nozzle region is fully pressurized. Thereby, the pressurized sliding area is balanced hydrostatically, so that the mechanical load is applied to a comparatively large area thus allowing the p·v-Factor to be larger.

Summarizing the inventive features, the invention in comparison to known methods and devices allows the device of the invention to handle loads increased by up to 4 times compared to current devices of the same type with nearly unlimited lifetime. Particularly the lifetime of the device is longer than the lifetime of the nozzle bore, which wears out by high pressure flow, so that the invention involves considerable improvements.

The features described in the paragraph 1 above are considerably advantageous. The jetting fluid and the clean second fluid can be separated by an elastic membrane, e.g. a rubber membrane.

The separation can be accomplished using a microfilter to ensure that the second fluid is clean, since no or a comparatively low flow passes through the filter. The membrane and/or the filter can be arranged so that they are sliding (e.g. rotating or tilting) over one or more surfaces, e.g. like a shaft seal.

The jetting fluid—excluding its contamination—can be chemically identical to the second fluid. For example, the jetting fluid may consist of somewhat contaminated water, while the second clean fluid consists of the water, but water which is ultrafiltered or distilled. It is a considerable advantage to use oil or grease as the second fluid so that not only the running-in properties of the nozzle joint parts can be improved, but also at very high pressures the necessary sliding conditions can be improved by additives. When a membrane is used which completely seals the fluids from each other, the jetting fluid may contain chemicals which cannot be allowed to enter the nozzle joint region, so its is unnecessary to flush the apparatus to prevent the nozzle joint parts from sticking together or getting damaged, which is a problem in the case of known systems, since the flushing fluid does not easily pass into inaccessible or difficult to reach spaces.

As a result of the aforesaid features the nozzle joint parts have ideal sliding conditions directly at the contacting areas, so that higher loads are permissible while maintaining a lengthened apparatus lifetime.

In the case of the features described in paragraph 2 above the following can be considered as particularly advantageous: The motor (e.g. an axial or radial turbine) drives a cam which operates in a slot of a slider, so that at least the internal end of the movable nozzle or an extension thereof can be moved back and forth. The slot within the slider, and the cam can be shaped to produce a comparatively constant speed (compared to sinusoidal speed changes this results in a rather flat curve in the middle and a rather quick speed change when close to the dead points) over a wide angle which at a given p·v-Factor can be selected close to the highest speed of a sinusoidal curve or of the highest drive speed according to DE-Gbm GM 80 29 704.

The sliding speed of the nozzle joint additionally or separately can be made constant by designing an adequate cam shape for driving the slider. It is possible to arrange two cam curves for each displacement portion of the cam.

It is unimportant how the slider is sliding, e.g. using one or more pins arranged within or beside it, or using bores within the housing in which slider extensions are sliding, by guiding grooves, edges or the like.

Further it is unimportant whether the driven cam and/or the internal end of the nozzle are arranged. They can be centrally, eccentrically or laterally located relative to the slider. They can be above or below the slider. This is true, if the nozzle extension extends into the slider either by only one or by multiple extended portions or members.

By these features, which are only at first sight independent of each other, the sliding conditions of the nozzle joint are improved, i.e. at the contacting areas where friction develops, so that the load capacity and life are improved.

In the case of the features described in paragraph 3 above the following is particularly advantageous: The super-hard ceramic surface can be achieved by spraying, sintering, baking or otherwise. Alternatively the nozzle and its cup can be made entirely of ceramic material. It is important in the case of these—only at first sight independent—means, which however are within the scope of the invention, that, due to a super-hard and thermally highly resistant surface, the p·v-Factor and the sliding properties directly at the sliding areas are positively influenced, while dirt particles cannot penetrate the surface and thereby cannot reduce the p·v-Factor.

In the case of paragraph 4 above the following is particularly advantageous: A circular relief groove is not required, but one or more can be oval or equidistant from the slot where the jet passes. It is also possible to provide several radial grooves close to the slot where the jet passes, so that the full area over which the working pressure is applied is as close as possible to the slot. In case of these—only at first sight independent—features, the sliding properties directly at the sliding areas are positively influenced and the load capacity and life are increased because of an improved p·v-Factor due to hydraulic balance.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE PREFERRED EMBODIMENTS

Figure 1:
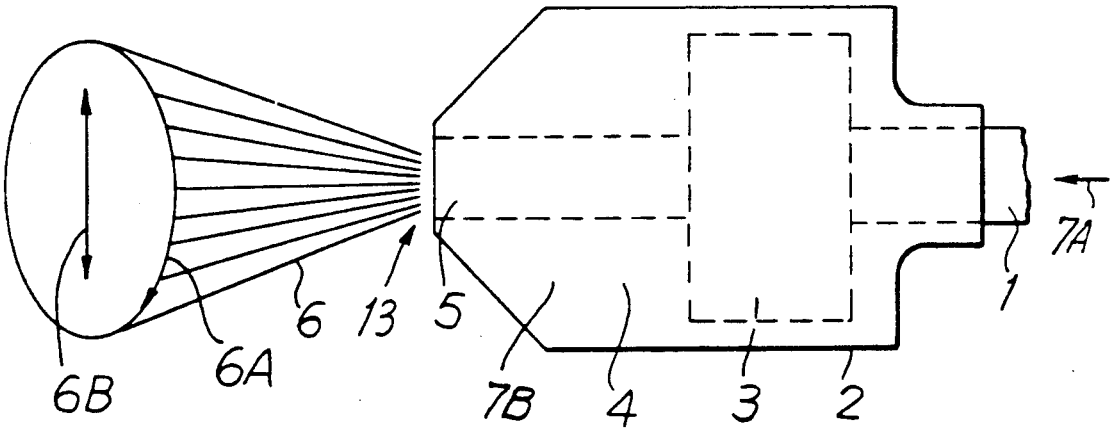
FIG. 1 is a schematic cross sectional view of an device for making a movable fluid jet according to the invention, wherein the fluid jet rotates (6A) or moves back and forth (6B)

The device shown in FIG. 1 has a connection pipe 1 connected to an unshown means, e.g. a jetting gun, for feeding pressurized fluid into fluid inlet 7A of the housing 2 of the nozzle device. The device has a housing 2 containing a motor means 3 (e.g. an axial or radial turbine) driven by the pressurized fluid admitted through fluid inlet 7A, which enters a first pressurized fluid space 7B once it has lost a small part of its energy for driving purposes. There is a dynamic high pressure seal 5 driven by motor means 3 in housing 2. When downstream pressurized fluid in the first pressurized fluid space 7B is forced through a movable nozzle 13, a moving fluid jet in the form of a conical surface 6A or a fan 6B or some other shape is formed.

The invention provides a considerable increase in the load capacity and life of the dynamic high pressure seal 5.

Figure 2A:
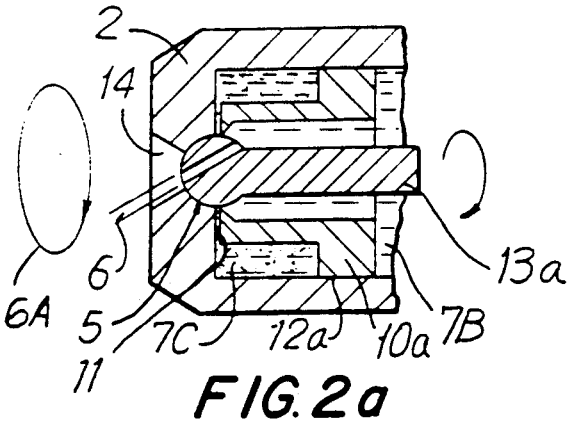
FIG. 2*a* is a cross-sectional view through a fluid jetting device, in which a centrally turning nozzle 13*a* is mounted within a ball joint having an exit bore at a predetermined angle to the turning axis of the nozzle.

The embodiment of the nozzle jet device shown in FIG. 2*a* has a nozzle 13*a* rotating about its axis and producing a conical jet through its angular bore. During operation the high pressure seal 5 is strongly stressed with real lubrication so that this embodiment of the nozzle jet device does not have a substantially longer life and high pressure resistant seal. The remaining figures show improved embodiments having longer life and a high pressure resistant seal.

Mechanical separating means 10*a* prevent direct access of contaminated pressurized fluid to high pressure seal 5, while simultaneously the pressure of downstream pressurized fluid in the first pressurized space 7B is transferred to clean pressurized fluid space 7C for relief and lubrication. Seal lip 11 of mechanical separating means 10*a* therefore is hydraulically balanced while dirt, minerals and chemicals within the pressurized fluid cannot pass to the high pressure seal 5, so that the sliding portions of the nozzle joint cannot accumulate particles on the sliding surfaces and scratching and wear of the surfaces can thus be avoided. Consequently, considerably smaller friction factors occur, the p·v-Factor increases, and the high pressure seal 5 and the entire device shown in the drawing can be used at higher load. It is unimportant if the pressure balance between the first pressurized fluid space 7B and the hydrostatically balancing pressurized fluid space 7C is achieved by mechanical deformation or axial movement of mechanical separating means 10*a*, e.g. at its outer surface or by other means. Hydrostatically balancing pressurized fluid may consist of grease, oil or pure water, etc, since high pressure seal 5 does not consume fluid in the structure according to the invention.

Figure 2B:
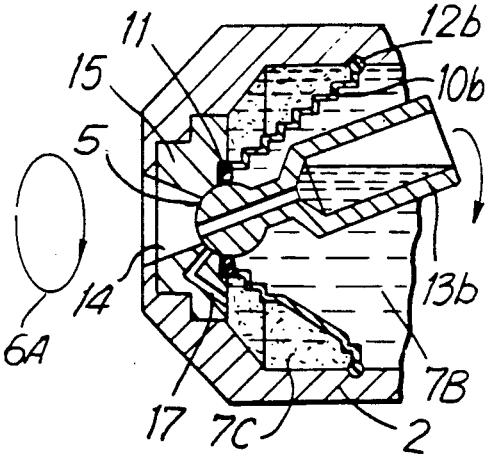
FIG. 2*b* is a cross-sectional view through a fluid jetting device, in which a nozzle 13*b* has a central bore, is mounted within a ball joint and turns or wobbles therein to form a conical jet.
Figure 2C:
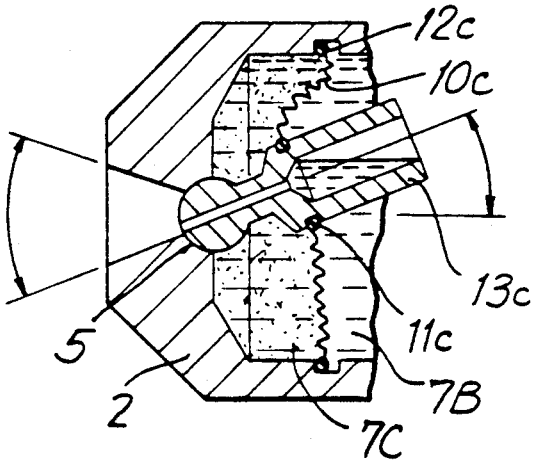
FIG. 2*c* is a cross-sectional view through a fluid jetting device, in which a nozzle 13*c* is mounted within a ball joint and swivels back and forth to describe a conic section-shaped jet.
Figure 2D:
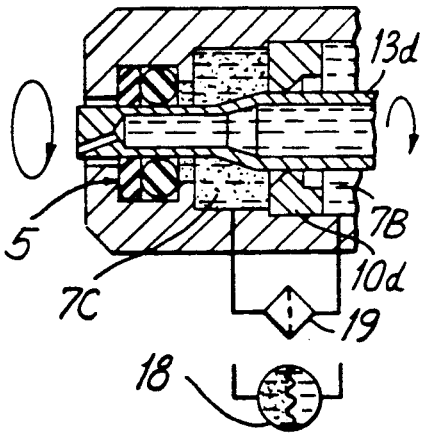
FIG. 2*d* is a cross-sectional view through a fluid jetting device, in which a centrally turning, cylindrically mounted nozzle 13*d* with exit bore oriented at a predetermined angle to the turning axis is shown with a filter added diagrammatically and, as an alternative, with a pressure bladder.
Figure 2E:
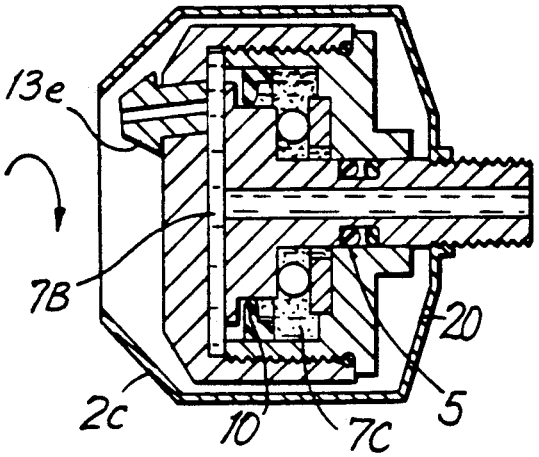
FIG. 2*e* is a cross-sectional view through a fluid jetting device, in which an eccentrically arranged and alternatively tilted nozzle 13*e* produces a fluid jet on a conical surface or a hyperbolic surface.

According to the embodiment shown in FIG. 2*b*, seal lip 11 can be directly applied to high pressure seal 5, while a hydrostatic relief groove 16 is connected to the second pressurized fluid space 7C via connecting channel 17. Further a cup 15 may be inserted. According to FIG. 2*c* mechanically separating means 10*c* can be inserted with its inner rim or a seal lip 11*c* into a groove of nozzle 13*c*, and/or an outer seal surface 12*c* can be provided in the housing 2. It is not necessary to have a hermetic seal, if only the major portion of the contamination of the seal surfaces is to be eliminated. According to the embodiment shown in FIG. 2*d* the pressure balance between the fluid in space 7B and that in the fluid space 7C is achieved alternatively by a rubber membrane (bladder) 18 or an ultrafilter 19, both of which can be arranged within the device. It is unimportant, if the housing is stationary or rotating according to FIG. 2*e*, while a cap 20 may be provided for safety reasons.

According to the embodiments shown in FIGS. 3*a* to 3*f* high pressure seal 5 can be further improved. According to the embodiment in FIG. 3*a* a slider 22 is provided and is driven by a cam 23, which is connected to motor means 3 rotating on shaft 32*a* (e.g. an axial turbine driven by pressurized fluid supplied via stream channels 26*a* and inlet channels 25*a*), so that slider 22 moves up and down with pins 24 within the guides 27. Then nozzle 13 is moved up and down by joint 29*a*, which comprises the upstream end of the nozzle 13 and slot 31 of the slider into which the upstream end of the nozzle extends. Since the outer shape of cam 23 and the shaped space 30 can be selected in many ways, slider movement can be controlled within broad limits. The moving speed of the nozzle can be made constant accordingly. Consequently, high pressure seal 5 may move at constant speed over a wide range, overloads due to sinusoidal excess speeds are avoided and speeds as well as p v Factors can be kept effectively constant.

Figure 3A:
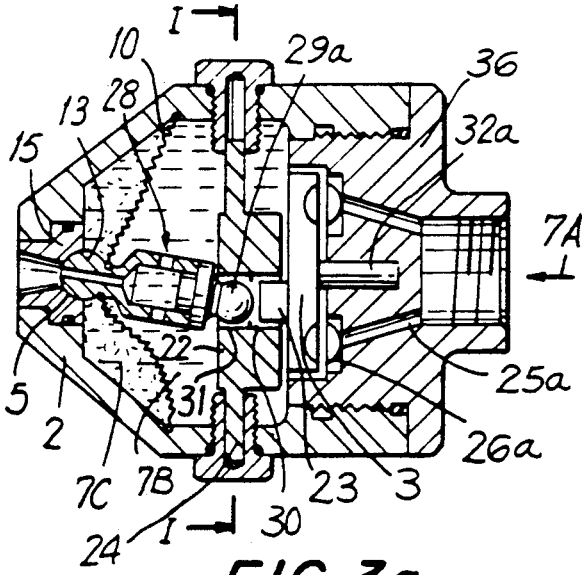
FIG. 3*a* is a cross-sectional view through a complete fluid jetting device according to the invention, which has an axial turbine as a motor and the motion is transferred by a cam 23 and a slider 22 for driving a swivelling nozzle 13.
Figure 3B:
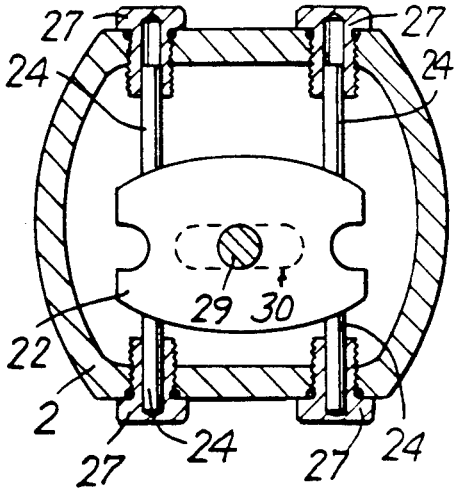
FIG. 3*b* is a cross-sectional view through a complete fluid jetting device of FIG. 3*a* taken along the section line I—I in FIG. 3*a*.
Figure 3C:
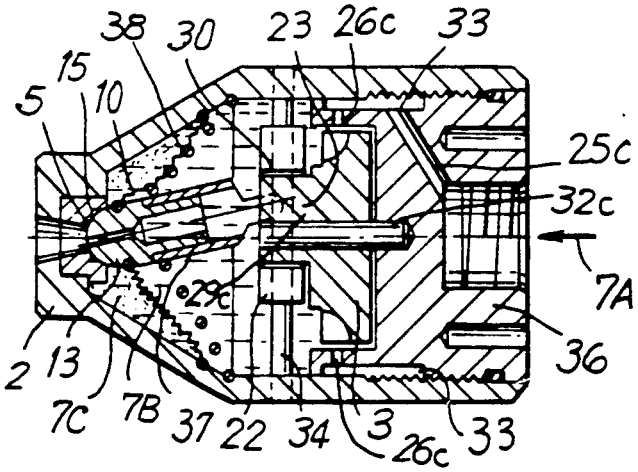
FIG. 3*c* is a cross-sectional view through a complete fluid jetting device according to the invention, which is driven by a radial turbine as motor means 3 and motion is transferred by cam 23 and a slider 22 for driving a swivelling nozzle 13.
Figure 3D:
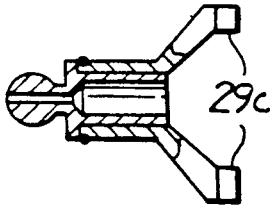
FIG. 3*d* is a cross-sectional view of the swivelling nozzle 13 from the device shown in FIG. 3*c* including its drive fork 29*c*.
Figure 3E:
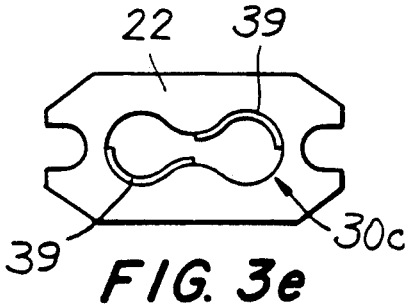
FIG. 3*e* is a plan view of the slider 22 of the device shown in FIG. 3*c*.
Figure 3F:
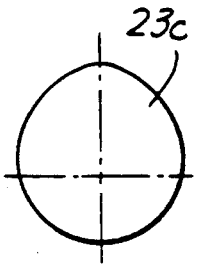
FIG. 3*f* is a plan view of a cam 23 of motor means 3 of the device shown in FIG. 3*c*.

Joint 29*a* of nozzle 13 need not be ball-shaped, but can also be cylindrical and tilting. It can extend into the slider 22 two or more according to FIG. 3*d*. FIG. 3*c* shows one possibility for the structure of a driving fork 37, which allows forces to act centrally through the slider, thus avoiding clamping and stalling. Fork 37 or some other nozzle extension (or nozzle 13 itself) can be pressed by spring 38 into cup 15, which alternatively is possible by elastic deformation of mechanical separating means 10.

According to the embodiment of FIG. 3*c* motor means 3 is a radial turbine, which is driven by tangential jets of pressurized fluid via inlet channels 25*c*, axial channels 33 and stream channels 26*c*.

Slider opening 30*c* has a shape allowing in combination with cam 23*a* almost linear swivel speeds of nozzle 13. Additionally, slider opening 30*c* need only be designed precisely at its driving surface opposite to cam 23, i.e. where cam 23 contacts the slider when operating.

Figure 4A:
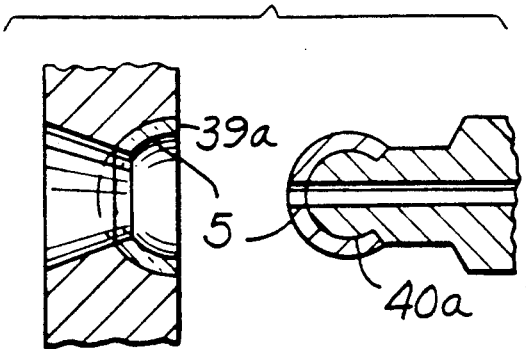
FIG. 4*a* is a cross-sectional view of a nozzle joint from an device according to the invention showing a coated ball cup and a coated ball end of a nozzle.
Figure 4B:
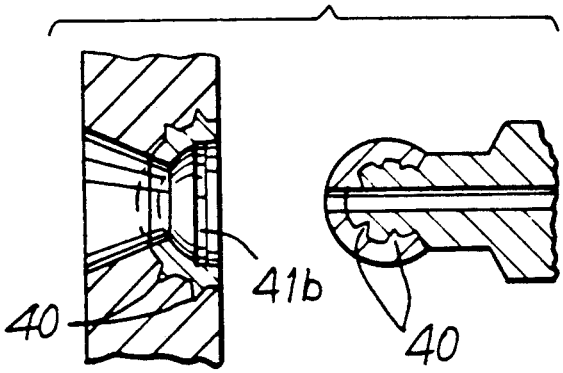
FIG. 4*b* is a cross-sectional view of a nozzle joint from an device according to the invention showing a ball cup and a ball end of a nozzle according to FIG. 4*a*, but with a mesh between the coating and the base material.
Figure 4C:
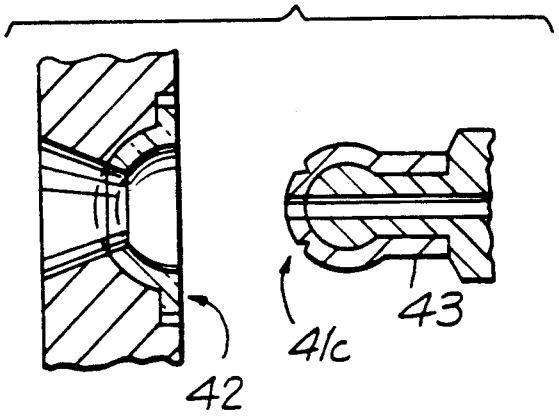
FIG. 4*c* is a cross-sectional view of a nozzle joint from an device according to the invention showing a pressed glued ball cup coating and a pressed sprayed or sintered/baked ball coating of the nozzle.
Figure 5A:
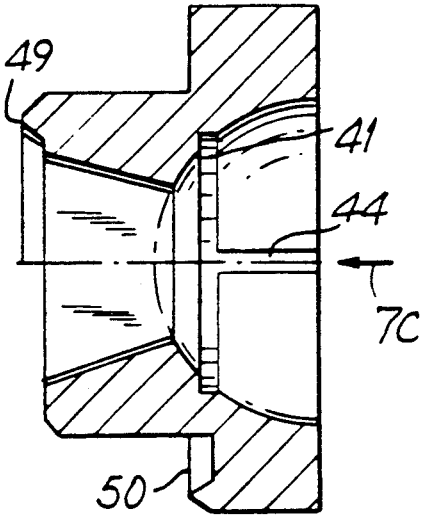
FIG. 5*a* is a cross-sectional view of a nozzle joint showing a ball cut relief groove 41 equidistant from jet orifice 14 according to FIG. 5*c*.
Figure 5C:
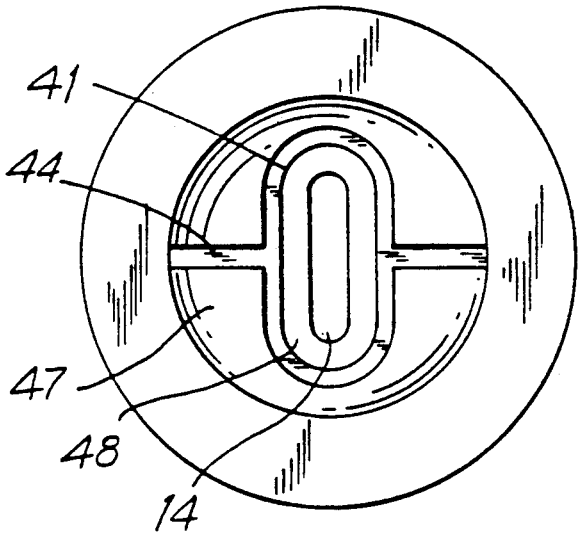
FIG. 5*c* is a side view of the device shown in FIG. 5*a* as seen in the direction of the arrow.
Figure 5B:
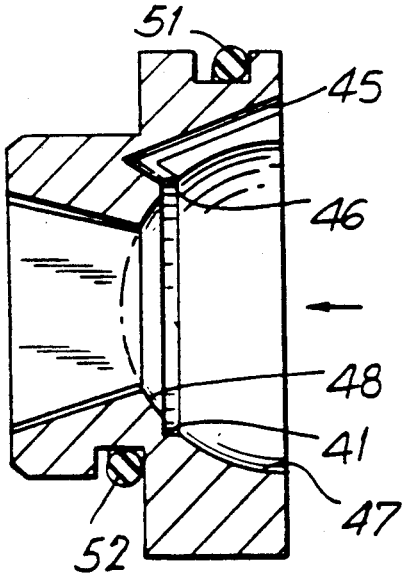
FIG. 5*b* is a cross-sectional view of a nozzle joint showing a ball cup with annular relief groove according to FIG. 5*d*.
Figure 5D:
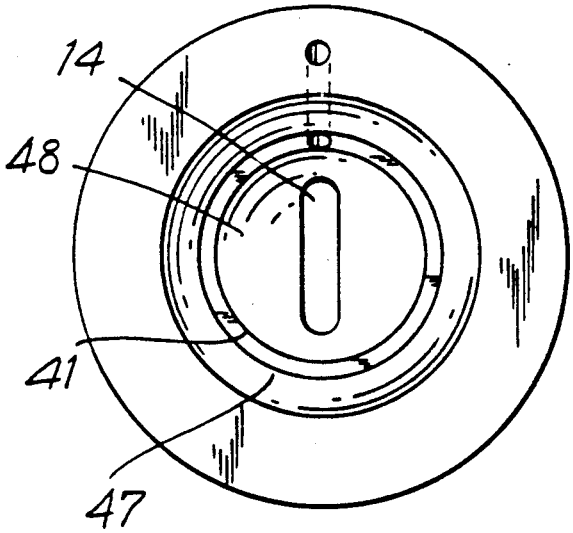
FIG. 5*d* is a side view of the device shown in FIG. 5*b* as seen in the direction of the arrow.

FIGS. 4*a* to 4*c* show how high pressure seal 5 is provided with improved sliding conditions and p·v-Factors by using a super-hard and thermally resistant ceramic surface or coating 39*a* for the ball cup and/or the sliding surface 40*a* of the nozzle 13. The sliding surface can be anchored in the base surface or grooves 40 for better adherence. According to FIG. 4*b*, grooves 40 are opposite to a groove 41*b* so that the sliding coating thickness is rather constant. Alternatively or additionally, the sliding surface or coating can have a supporting edge 42 or a diameter reduction 43 producing better support.

Of course, the sliding surface of super-hard and thermally resistant material can be comparatively thick or extend over the entire nozzle or its cup. As a result, production economies can be attained, particularly in the case of small nozzles.

An additional improvement of the p·v properties of the high pressure seal 5 can be achieved by hydrostatic relief or balance according to FIGS. 5*a* to *d*. According to FIG. 5*a* and 5*c* a groove 41 is provided, preferably equidistant, around jet orifice 14, which is connected by connecting groove(s) 44 to the second pressurized fluid space 7C, so that the pressurized fluid is working on the entire external supporting area 47. Thus this area including the area of groove 41 and connecting groove 44 is completely balanced hydraulically, while onto internal supporting area 48 only a pressure differential will act and the area of the jet orifice 14—not including the jet recoils—is unbalanced. In summary, the hydrostatically unbalanced forces and the remaining forces from inside the housing act on internal supporting area 48 and internal supporting area 47, so that considerably improved sliding conditions result as compared to unbalanced designs and thereby higher loaded areas. It is understood that according to FIGS. 5*b* and 5*d* connecting groove 44 can be replaced by connecting channels 45 and 46 feeding pressurized fluid into groove 41, which must not necessarily form a completely closed ring, but which can be open.

Finally, the features of the invention not only attain higher working pressures and higher life, but also, due to strongly reduced friction at high pressure seal 5, result in smaller drive power being required, thereby resulting in a higher effective jetting power and smaller drive pressures for motor means 3, so that excess speeds are avoided and speed brakes as known from common device are unnecessary.

By "sliding members" in the following claims we means cup 15 or similar surfaces on the housing 2 and the head 13*a*.

It will be understood that each of the elements described above, or two or more together, may also find a useful application in other types of constructions differing from the types described above.

While the invention has been illustrated and described as embodied in a improved fluid jetting device for cleaning surfaces, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. In a fluid jetting device for cleaning surfaces comprising a housing having a fluid inlet for pressurized fluid, said housing having a first pressurized fluid space communicating with said fluid inlet, and at least one movable high pressure nozzle in said housing producing at least one moving fluid jet, said nozzle being mounted movable in said housing by action of said pressurized fluid, a high pressure seal being formed between said nozzle and said housing, the improvement comprising at least one mechanical separating means mounted in said housing to form a second pressurized fluid space adjacent said high pressure seal, said second pressurized fluid space being at least partially separated from said first pressurized fluid space by said mechanical separating means, and said mechanical separating means at least partially preventing said pressurized fluid from reaching said second pressurized fluid space but being structured so that fluid pressure from said first pressurized fluid space is transferred to another pressurized fluid located in said second pressurized fluid space located adjacent said high pressure seal, said mechanical separating means thus at least partially preventing foreign material in said pressurized fluid from reaching said high pressure seal so as to reduce friction at said high pressure seal and lengthen effective operating life.

2. The improvement as defined in claim 1, wherein said mechanical separating means completely separates said first pressurized fluid space from said second pressurized fluid space so that said pressurized fluid from said first pressurized fluid space is prevented from reaching said second pressurized fluid space.

3. The improvement as defined in claim 1, wherein said mechanical separating means comprises a membrane.

4. The improvement as defined in claim 1, wherein said mechanical separating means comprises a filter.

5. The improvement as defined in claim 1, wherein said mechanical separating means permits an amount of said pressurized fluid to flow from said first pressurized fluid space to reach said second pressurized fluid space.

6. The improvement as defined in claim 1, wherein said other pressurized fluid is a lubricating fluid.

7. The improvement as defined in claim 6, wherein said lubricating fluid is a grease.

8. The improvement as defined in claim 6, wherein said lubricating fluid is an oil.

9. In a fluid jetting device for cleaning surfaces comprising a housing having a fluid inlet for pressurized fluid, said housing having a first pressurized fluid space communicating with said fluid inlet, and at least one movable high pressure nozzle in said housing producing at least one moving fluid jet, said nozzle being mounted movable in said housing by action of said pressurized fluid, a high pressure seal being formed between said nozzle and said housing, the improvement comprising motor means for moving said nozzle indirectly connected with said nozzle and a slider for motion transfer from said motor means to said nozzle, said motor means being driven by said pressurized fluid, and wherein said slider is provided with a slider opening and said motor means has a cam engaging in said slider opening so that said slider is driven when said motor means operates, said slider being engaged with said nozzle so that said nozzle moves with said slider with said nozzle continuously tilted.

10. The improvement as defined in claim 9, wherein said slider opening is shaped so that said nozzle is movable at substantially constant speed.

11. The improvement as defined in claim 9, wherein said cam is shaped so that said nozzle is movable at substantially constant speed.

12. The improvement as defined in claim 9, wherein said cam and said slider opening are shaped so that said nozzle is movable at substantially constant speed.

13. The improvement as defined in claim 9, wherein said drive cam has a transverse cross section which is at least in part shaped like an Archimedic spiral.

14. The improvement as defined in claim 9, wherein said housing is provided with a hydrostatic relief groove in the vicinity of a fluid orifice of said nozzle.

15. The improvement as defined in claim 14, wherein said hydrostatic relief groove is equidistant to said fluid orifice.

16. A method of improving the action of at least one movable high pressure nozzle producing at least one moving fluid jet in a jetting device having a housing with a fluid inlet for a first pressurized fluid, a first pressurized fluid space communicating with said fluid inlet, and a second pressurized fluid space containing a second pressurized fluid in the vicinity of the nozzle, said high pressure nozzle being mounted movable in said housing by action of said first pressurized fluid, and further comprising a first sliding member attached to the nozzle and a second sliding member attached to the housing, said sliding members forming a high pressure seal between said nozzle and said housing, comprising the steps of:

a. preventing said first pressurized fluid in said first pressurized fluid space from reaching said high pressure seal by separating said first pressurized space from said second pressurized space; and b. balancing the fluid pressure in the vicinity of said high pressure seal so as to reduce friction between said sliding members.

17. A method according to claim 16, wherein said balancing includes transmitting the fluid pressure of said first pressurized fluid to said second pressurized fluid and providing a groove between the first and the second sliding members that communicates with the second pressurized space to permit said second pressurized fluid to flow between the sliding members to provide said balancing of the fluid pressure in the vicinity of said high pressure seal.

18. A method according to claim 17, wherein said second pressurized fluid is a lubricating fluid selected from the group consisting of oils and greases.

* * * * *